US006749002B2

(12) United States Patent
Grinberg et al.

(10) Patent No.: US 6,749,002 B2
(45) Date of Patent: Jun. 15, 2004

(54) METHOD OF SPRAY JOINING ARTICLES

(75) Inventors: Grigoriy Grinberg, Sylvania, OH (US); Matthew M. Shade, Plymouth, MI (US); David Robert Collins, Saline, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 10/065,459

(22) Filed: Oct. 21, 2002

(65) Prior Publication Data

US 2004/0076807 A1 Apr. 22, 2004

(51) Int. Cl.[7] ..... B22D 23/00
(52) U.S. Cl. ..... 164/46; 228/171; 228/262.41
(58) Field of Search ..... 228/262.41

(56) References Cited

U.S. PATENT DOCUMENTS 1,773,068 A * 8/1930 Vienneau ..... 219/105
1,863,873 A * 6/1932 Quarnstrom ..... 228/146
3,576,966 A * 5/1971 Sullivan ..... 219/137 R
4,034,179 A * 7/1977 Koshiga et al. ..... 219/74
5,070,228 A * 12/1991 Siemers et al. ..... 219/121.46
5,273,204 A * 12/1993 Dalal et al. ..... 228/166
5,305,816 A * 4/1994 Ikawa ..... 164/46
5,505,365 A * 4/1996 Olsen ..... 228/135
5,658,506 A 8/1997 White et al.
5,915,743 A * 6/1999 Palma ..... 29/402.18
5,967,218 A * 10/1999 Pergande et al. ..... 164/46
6,257,309 B1 7/2001 Kinane et al.
6,258,402 B1 7/2001 Hussary et al.
6,276,431 B1 8/2001 Grinberg et al.

* cited by examiner

*Primary Examiner*—Kuang Y. Lin
(74) *Attorney, Agent, or Firm*—Damian Porcari

(57) ABSTRACT

The present invention relates to a method of providing a spray formed composite article. The method comprises providing a first article. The first article is a spray formed article. A second article is located adjacent the first article. Metallic particles are sprayed onto the articles and allowed to form a metal deposit that extends between and connects the first and second articles.

26 Claims, 3 Drawing Sheets

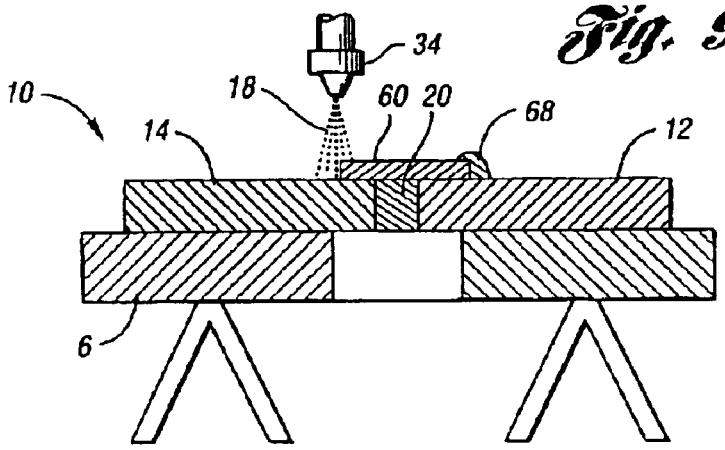
Fig. 9
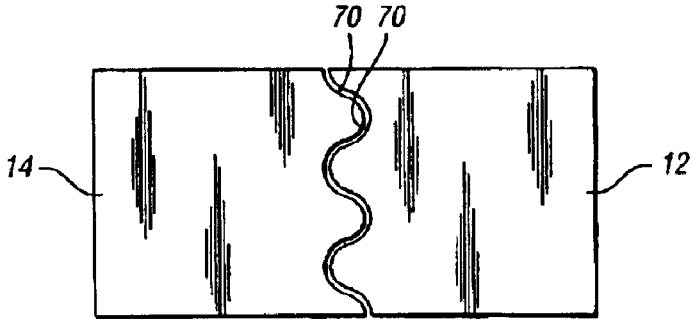
Fig. 10
Fig. 11
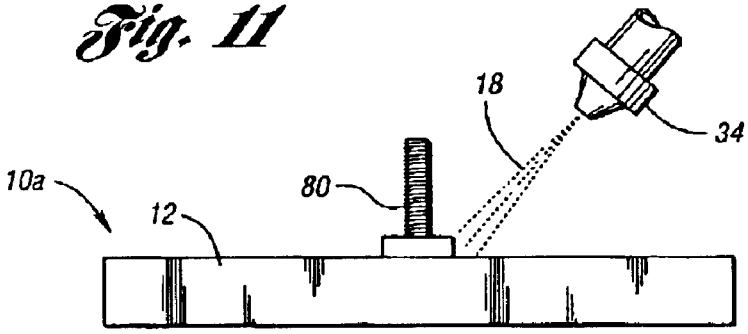
Fig. 12
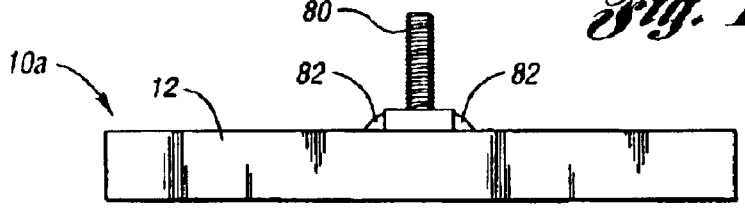

METHOD OF SPRAY JOINING ARTICLES

BACKGROUND OF THE INVENTION

1. Field of the Invention

In at least one aspect, the invention relates in general to articles joined together by spray forming and, more particularly, to articles produced by spray joining together one or more smaller spray formed articles.

2. Background Art

It is well known to make spray formed articles such as relatively small spray formed tools and dies. In a typical spray forming process, a metallic material, such as steel, is sprayed onto a pattern, typically made of ceramic, and allowed to cool to form a desired article. These articles typically have length and width dimensions ranging between about 1 millimeter by 1 millimeter to about 1 meter by 1 meter.

Because of various spatial and processing limitations, mainly dealing with maintaining the spray forming temperature at a certain level, it has been somewhat impractical to produce spray formed articles larger than about one meter by one meter. As such, there are many types of steel articles that because of their shape or size are not able to be formed by conventional spray forming processes. For instance, one-piece molding shells and stamping tools for large parts, such as automobile hoods, have not been successfully formed using conventional spray forming techniques because of the inherent limitations in current spray forming techniques.

Additionally, there are instances where it is desirable to join a spray formed particle, of a specific type of metal, with a second article of a different type of metal. For instance, there are several instances where it is desirable to have a screw, or other fastening rod, secured to a spray formed article. One particular example is with a lay-up tool or one-sided tool which requires a back support structure attached to the spray formed face. Presently, acceptable bonds between articles of dissimilar materials are not able to be obtained via welding or other conventional metal joining techniques.

Accordingly, it would be desirable to provide a process for manufacturing articles of the shapes and/or sizes and/or constitutions discussed above via conventional spray forming processes.

SUMMARY OF THE INVENTION

In at least one embodiment, the present invention takes the form of a method of spray forming together at least two or more articles. The method comprises providing a first spray formed article and locating a second article adjacent the first article. The method further comprises spraying metallic particles onto the articles and allowing the sprayed metal particles to form a metal deposit connecting the first article with the second article.

BRIEF DESCRIPTION OF DRAWINGS

The invention will now be described in greater detail in the following way of example only and with reference to the attached drawings, in which:

FIG. 9 is a schematic diagram illustrating another embodiment of the present invention;

FIG. 10 is a schematic diagram illustrating another embodiment of the present invention; and FIGS. 11 and 12 are schematic diagrams illustrating another embodiment of the present invention.

DETAILED DESCRIPTION

Figure 1:
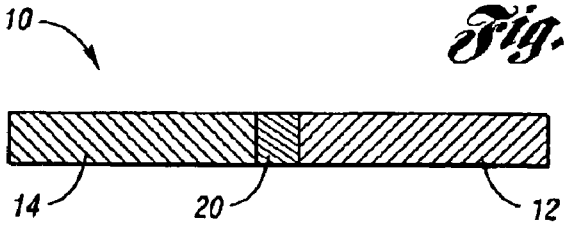
FIGS. 1–4 are schematic diagrams illustrating an embodiment of the present invention.

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

As shown schematically in FIGS. 1–4, the present invention relates to a process of spray forming, and thus joining, a first spray formed article 12 with a second article 14 to form a composite spray formed article 10. The process of this invention generally comprises four basic steps: (a) providing a first-spray formed article 12; (b) locating a second article 14 adjacent the first article 12; (c) spraying metal particles 18 onto the articles 12 and 14; and (d) allowing the sprayed metallic particles to form a metal deposit 20 extending between and connecting the first and second articles. The method forms a composite article 10 comprising the first and second articles 12 and 14 joined together by the spray formed metal deposit 20.

The first article 12 comprises a spray formed article. The second article 14 can preferably be made of any type of metallic material and in accordance with a suitable type of fabrication method, however, is preferably also a spray formed article. By "spray formed", it is meant an article that is formed by spraying particles, and preferably metallic particles, at a spray forming pattern. Any suitable spray forming technique can be used to form the first article 12 and if desired, the second article 14. Examples of suitable spray forming techniques include those disclosed in U.S. Pat. Nos. 6,276,431, 5,967,218, and 5,658,506.

Figure 2:
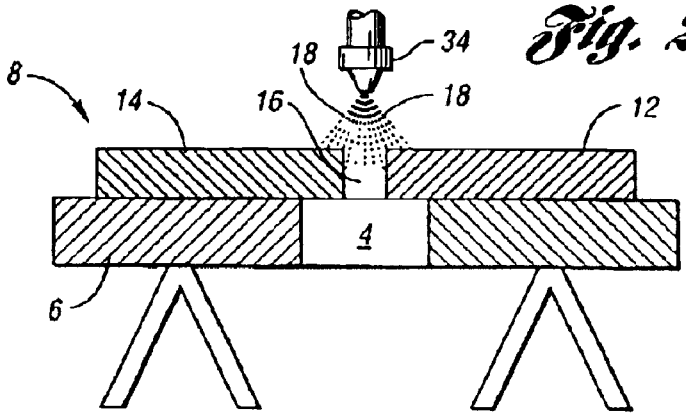

As shown schematically in FIG. 2, a pre-processed assembly 8 is provided comprising the first article 12 and the second article 14. The articles 12 and 14 are located on a support, such as a table 6, proximate to each other. The table 6 has a cavity 4 to allow spray to pass through and avoid back pressure from the spray. Alternatively, two spaced-apart tables could be used instead of table 6. As shown in some of the Figures, the articles 12 and 14 could be spaced apart so that a distinct gap 16 is present between the first and second articles. It should be noted that, if present, the gap 16 can be any size, but is preferably about 0.001–5 mm and, more preferably, about 0.1–4 mm. The articles 12 and 14 could alternatively be touching at one or more locations.

One or more spray guns 34, shown schematically in the Figures, is preferably utilized to spray the particles 18 onto the first and second articles 12 and 14 and, if present, into the gap 16. The spraying material utilized for the spray gun(s) 34 is often times dependent upon the material that the articles 12 and 14 are made of. In many instances, the articles 12 and 14 are spray formed articles and are being joined to form a relatively large tooling shell or die. In these instances, both of the articles 12 and 14 are preferably spray formed of a metal, such as carbon steel, and thus the spraying material utilized to form the deposit 20 is preferably carbon steel. It should be readily understood that other materials such as, zinc, aluminum and alloys could also be used in place of the steel.

While any suitable spray forming gun could be employed, one suitable example of a spray forming gun is an oxy-acetylene flame type thermal spray gun in which a wire or powder metal is fed there into. Cold spraying guns could be used in place of thermal spray guns to spray metallic particles onto the articles 12 and 14 and into the gap 16.

Also, a single or two wire arc, thermal spraying gun(s) could be used. In a two-wire arc thermal spray gun, an electric arc is generated in a zone between two consumable wire electrodes. As the electrodes melt, the arc is maintained by continuously feeding the electrodes into the arc zone. The metal at the electrode tips is atomized by a blast of generally cold compressed gas. The atomized metal is then propelled by the gas jet towards the pre-processed assembly 8.

In a single wire arc apparatus, a single wire is fed either through the central axis of the torch or is fed at an acute angle into a plasma stream that is generated internally within the torch. The single wire acts as a consumable electrode that is fed into the arc chamber. The arc is established between the cathode of the plasma torch and the single wire as an anode, thereby melting the tip of the wire. Gas is fed into the arc chamber, coaxially to the cathode, where it is expanded by the electric arc to cause a highly heated gas stream (carrying metal droplets from the electrode tip) to flow through the nozzle. A further higher temperature gas flow may be used to shroud or surround the spray of molten metal so that droplets are subjected to further atomization and acceleration.

Yet still other wire arc torch guns may be utilized that use a transferred-arc plasma whereby an initial arc is struck between a cathode and a nozzle surrounding the cathode. The plasma created from such arc is transferred to a secondary anode (outside the gun nozzle) in the form of a single or double wire feedstock causing melting of the tip of such wire feedstock.

Figure 3:
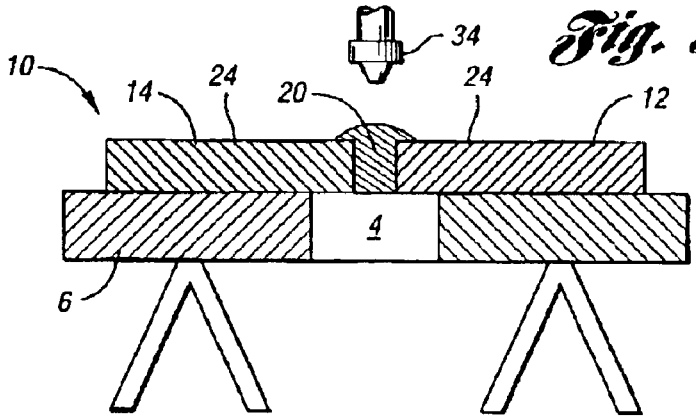

The spraying is continued so that repeated passes of the spray material will deposit a bulk deposit 20, as best shown in FIG. 3, that will essentially fill any gap 16 that existed between the articles 12 and 14 and connect the first and second articles 12 and 14 to each other. Preferably, after spraying, the deposit 20 extends at least above the adjacent upper surface portions 24 of the articles 12 and 14.

Figure 5:
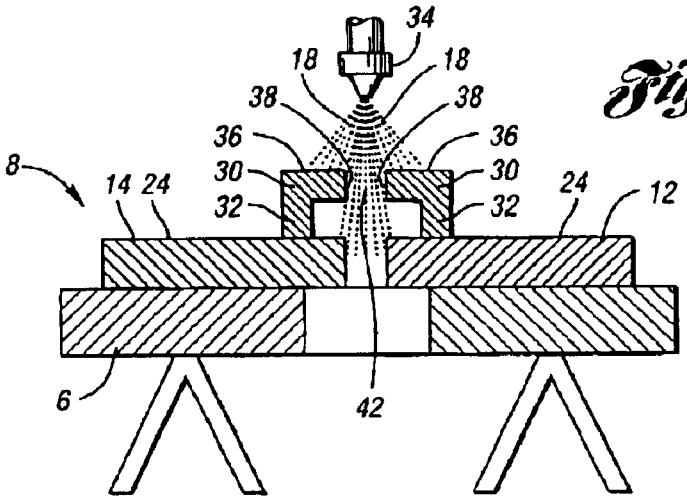
FIG. 5 is a schematic diagram illustrating another embodiment of the present invention.

In one embodiment, as shown schematically in FIG. 5, masking devices 30 are provided on the articles 12 and 14 to cover and prevent excessive over spraying from accumulating on the adjacent upper surface portions 24 of the articles 12 and 14 during spraying. While the masking devices 30 could embody many different designs, the masking devices 30 are preferably made of metal, or other high heat resistant material, such as ceramics and high heat tape, and are preferably configured as shown in FIG. 5. Preferably, the masking devices 30 are somewhat "L" shaped and have a first leg portion 32, extending essentially perpendicularly away from the upper surface 24 of the articles 12 and 14, and a second leg portion 36 extending essentially coplanar with surfaces 24 away from first leg portion 32 and towards the other leg portion 36. The masking devices 30 each have end surfaces 38 facing each other that help to define a gap 42. Gap 42 is between gun 34 and the articles 12 and 14 and is positioned to direct the particles 18 to the specific area(s) in need of spraying, i.e., the area to be filled with deposit 20 to connect articles 12 and 14, thereby preventing unnecessary over-spraying. The masking devices 30 are preferably secured to the articles 12 and 14 by clamps and/or some other type of securing means such as screw, glue, etc.

During spraying, the temperature of the articles 12 and 14 are preferably monitored to maintain a desired temperature to avoid overheating and warping of the article 12 and 14. The desired temperature will vary depending upon the materials being used, but is typically between 20° C.–400° C. The deposited material, by way of the heat received from the spraying operation, remains at a temperature which is sufficient to inhibit the formation of internal stresses in the deposited material.

Figure 4:
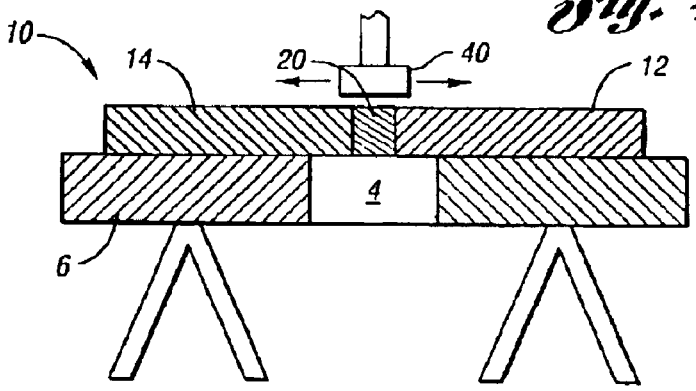

After the spraying step, if necessary, the deposited bulk material 20 and the articles 12 and 14 are allowed to cool, preferably by air, to room temperature. After spraying, the masking devices 30, if used, are removed and the deposit 20 (FIG. 3), which at this time preferably extends above the adjacent upper surfaces 24 of the articles 12 and 14, is ground flush, with the adjacent upper surface of the articles 12 and 14 as shown in FIG. 4, via any suitable grinding device 40. After grinding, the upper surface of the deposit 20 is preferably smoothed so that the resulting composite article 10 can be ready for use as a tool, a mold component, or other device. Depending on the desired end product, the composite article 10 could have other articles joined thereto in a similar fashion to that described above. For instance, several articles cold be joined together to form a large stamping tool. It should be readily understood that the methods of the present invention could produce composite article for many various applications.

Figure 6:
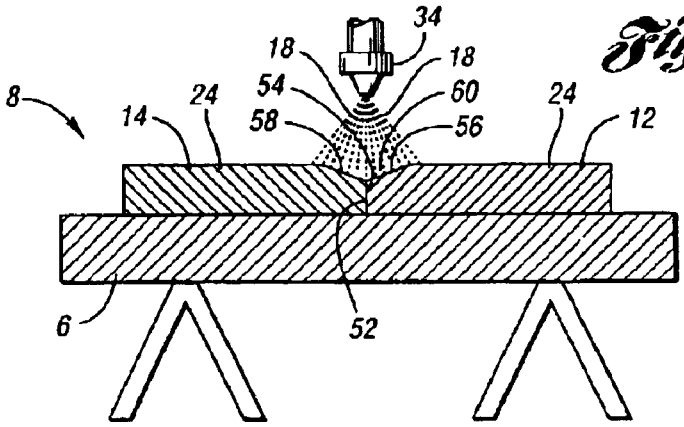
FIG. 6 is a schematic diagram illustrating another embodiment of the present invention.

In one embodiment, as shown schematically in FIG. 6, the articles 12 and 14 could have surfaces 52 and 54 respectively, that contact each other. Surfaces 52 and 54 are preferably coplanar and extend in a plane that is perpendicular to the plane in which upper surfaces 24 extend. The first article 12 has an intermediate surface 56 that extends between surface 24 and 52. The second article 14 has an intermediate surface 58 that extends between upper surface 24 of article 14 and end surface 54. Intermediate surfaces 56 and 58 preferably extend at an angle relative to upper surface 24. Preferably, intermediate surfaces 56 and 58 extend at an angle of preferably between about 5–60 degrees, more preferably about 10–25 degrees, and most preferably between 10–15 degrees, relative to upper surface 24.

The surfaces 56 and 58 are preferably milled, or otherwise formed. For instance, the surfaces 56 and 58 can be formed (i.e., via the pattern design) when the articles are being sprayed and are configured such that when the end surfaces 52 and 54 of the articles 12 and 14, respectfully, are contacting each other, a gap 60 having a somewhat triangular cross-section is formed between articles 12 and 14. The gap 60 provides an optimal shaped receptor for receiving the sprayed particles 18 due to the nature of the spray forming process. This configuration provides increased surface area which enhances spray adhesion thereby generating a stronger joint. Preferably, the width of the gap 60, i.e., the distance between the adjacent ends of the upper surfaces 24, is typically about one and a half to three times, and more preferably twice the thickness (i.e., vertical height) of the thicker of the articles 12 and 14, provided that each of the articles have roughly similar thicknesses.

Figure 7:
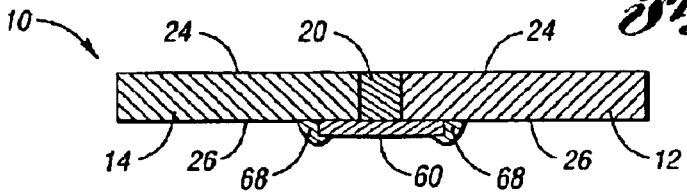
FIGS. 7–8 are schematic diagrams illustrating another embodiment of the present invention.

In one embodiment, as shown schematically in FIG. 7, the composite article 10 could include a back plate 60 or other reinforcement component, preferably provided on the underside of the first and second articles 12 and 14, beneath the deposit 20. The back plate 60 can be made of the same material as one or both of the first and second articles 12 and 14, or could be made of some other material. Examples of suitable materials include, but are not limited to, steel and tool steel. The back plate 60 or reinforcing material, can be secured to the articles 12 and 14 either during the step of forming the deposit 20, or after the step of forming the deposit 20.

Figure 8:
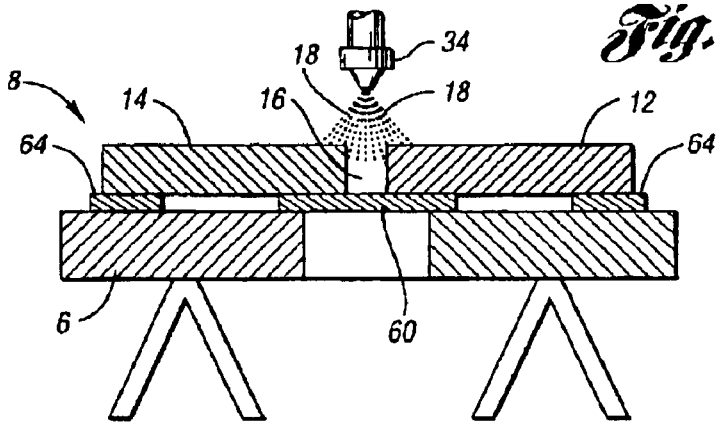

One example of securing a reinforcing material is shown schematically in FIG. 8. The back plate 60 sits below the articles 12 and 14, underneath the gap 16, as best shown in FIG. 8, prior to and during the spraying step. The lower adjacent surfaces 26 of the articles 12 and 14 rest on portions of the back plate 60. To keep the articles 12 and 14 aligned, i.e., in a planar relationship, support members 64 are preferably positioned below articles 12 and 14. After the spraying step and any necessary grinding or finishing steps, is performed, the deposit 20 extends between and connects articles 12 and 14 to each other as well as to the back plate 60.

To reinforce the bond between the composite article 10 and the back plate 60, the article 10 can be turned upside down so that the plate 60 is above the deposit 20 and additional deposits 68 can be spray formed to extend between and connect back plate 60 and articles 12 and 14. It should be readily appreciated that the back plate 60 could be secured to composite article 10 after the deposit 20 is formed by employing the method depicted in FIG. 9 and described above, and without employing the method depicted in FIG. 8.

In one embodiment, as schematically shown in plan view in FIG. 10, the articles 12 and 14 could have edges 70 that are shaped to provide improved bond strength between the articles 12 and 14. For instance, as shown in FIG. 10, the edges 70 are sinusoidal and in a complimentary relationship to provide better alignment and increased strength in the joined articles. Alternatively, the edges 70 could have chamfers, other types of grooves, or dovetails to aid in reinforcing the joint and locating the articles. The edges 70 are preferably milled or otherwise formed when forming/spraying the articles 12 and 14.

FIGS. 11 and 12 illustrate one example of using the technique of the present invention to form a composite article 10*a* comprising a first spray formed article 12 and a second non-spray formed article 80. While being shown in FIGS. 11 and 12 to be a pre-cast fastener, the second articles so can be any type of article, such as rebarb, bolts, pins, weld studs, etc., and can be made by any suitable techniques, such as machining bar stock, casting, etc. Prior to spraying the second article 80 can be placed directly on the first article 12, as shown in FIG. 11, or could be spaced some distance from the first article. The second article 80 can be glued, or otherwise held, such as via tack welding, clamped, brazed, onto the first article 12 Particles 18 are then sprayed at the intersection, or gap between the articles 12 and 80 as the case may be, to form one or more deposits 82 that extend between and connect the articles 12 and 80.

In an alternative embodiment, the second article 80 could be placed onto the first article 12 after some of the spraying has commenced and can be held in place by like methods to those discussed above and/or by the hardening of the previously sprayed material on the first article 12.

In yet another embodiment, the second article 80 could be spaced a distance from the first article 12.

It should be readily understood that the composite article 10*a* made in accordance with the embodiments illustrated in FIGS. 11 and 12 could have many various applications. One non-limited example is a lay-up tool mold.

It should also be readily understood that prior to spraying, the articles could be coated with a suitable adhesion promoter, or otherwise prepped, such as grit blasted to roughen the surfaces of the articles, to improve the overall quality of the sprayed joint, by improving the adhesion of the deposit 20 to the articles.

While the best modes for carrying out the invention have been described in detail, those familiar with the art to which this invention relates will recognize various alternative designs and embodiments for practicing the invention as defined by the following claims.

What is claimed is:

1. A method of providing a spray formed composite assembly, said method comprising:

(a) providing a first article, the first article being a spray formed steel article;

(b) locating a second metallic article adjacent the first article (c) spraying steel particles onto the articles while maintaining the temperature of the articles between 20° C. to 400° C.; and (d) allowing the sprayed steel particles to cool to form a metal deposit extended between and connecting the first and second articles.

2. The method of claim 1 wherein in step (b) a gap is formed between the first and second articles when the second article is located adjacent the first article.

3. The method of claim 2 wherein each of the first and second articles each have (i) upper surfaces spaced apart a first distance from each other and (ii) end surfaces that have portions that contact each other and each of the first and second articles have intermediate surfaces extending between and connecting each respective end surface with each respective upper surface.

4. The method of claim 3 wherein each of the intermediate surfaces extend at an angle of 5° to 25° relative to each respective upper surface.

5. The method of claim 1 wherein a reinforcing member is provided proximate the first and second articles and a metal spraying device is provided for spraying the metal particles of step (c), the first and the second articles being located between the metal spraying device and the reinforcing member.

6. The method of claim 5 wherein the metal deposit extends between and connects the reinforcing member with at least one of the first and second articles.

7. The method of claim 3 wherein two masking devices are provided, each masking device being adjacent an end portion of each of the upper surfaces of the first and second articles.

8. The method of claim 7 wherein at least one of the masking devices has a cutout portion extending away from the end portion of the upper surface.

9. The method of claim 2 wherein the first article has a first thickness and wherein the first distance is about two times the first thickness.

10. The method of claim 2 wherein the metal deposit has at least a portion that extends above the at least one of the upper surfaces.

11. The method of claim 10 further comprising the step (e) of grinding the metal deposit to form a portion of the deposit that is essentially coplanar with at least the upper surface of one of the articles.

12. The method of claim 1 wherein the second article is not a spray formed article.

13. The method of claim 12 wherein the second article comprises a securing member.

14. The method of claim 13 wherein the second article is located on the first article in step (b).

15. The method of claim 1 wherein each of the articles have an interface surface that substantially cooperates with each other.

16. The method of claim 1 wherein the second article comprises a spray formed article.

17. The method of claim 1 wherein the sprayed metallic particles are allowed to air cool to room temperature to form the metal deposit.

18. The method of claim 11 further comprising the step (f) of smoothing the grinded metal deposit to form a composite article having an essentially seamless upper surface.

19. The method of claim 6 further comprising the step of providing at least a second metal deposit that extends between and connects the reinforcing member and least one of the articles.

20. The method of claim 19 wherein the reinforcing member comprises a metal plate.

21. The method of claim 14 wherein the second article comprises a fastening member for fastening the composite article to a structure.

22. The method of claim 15 wherein the interface surfaces are sinusoidal-shaped.

23. The method of claim 1 wherein the second article contacts the first article in step (b).

24. A method of providing a spray formed part forming tool, said method comprising:

(a) providing a first spray formed steel article;

(b) locating a second spray formed steel article adjacent the first article;

(c) spraying steel particles onto the articles while monitoring and maintaining the temperature of the articles between 20° C. to 400° C.;

(d) cooling the sprayed steel particles to room temperature to form a metal deposit extending between and connecting the first and second articles;

(e) grinding the metal deposit flush relative to the articles; and (f) smoothing the deposit to form a spray formed part forming tool.

25. The method of claim 24 wherein the deposit is allowed to air cool to room temperature.

26. The method of claim 24 further comprising the step of placing a reinforcing plate adjacent the first and second articles prior to step (c) in an orientation that results in the deposit extending between and connecting the reinforcing plate and at least one of the articles at a first location, wherein after step (d), a second deposit is spray formed to extend between and connect the plate and at least one of the articles at a second location different from the first location.

* * * * *